US009920568B2

(12) United States Patent
Rethmeier et al.

(10) Patent No.: US 9,920,568 B2
(45) Date of Patent: Mar. 20, 2018

(54) COMPOSITE PROFILE FOR DOORS, WINDOWS OR FAÇADE ELEMENTS

(71) Applicant: SCHÜCO INTERNATIONAL KG, Bielefeld (DE)

(72) Inventors: Anke Rethmeier, Bielefeld (DE); Mathias Schiller, Halle (DE)

(73) Assignee: SCHÜCO INTERNATIONAL KG, Bielefeld (DE)

( * ) Notice: Subject to any disclaimer, the term of this patent is extended or adjusted under 35 U.S.C. 154(b) by 0 days.

(21) Appl. No.: 15/308,888

(22) PCT Filed: Apr. 29, 2015

(86) PCT No.: PCT/EP2015/059390
§ 371 (c)(1),
(2) Date: Nov. 4, 2016

(87) PCT Pub. No.: WO2015/169671
PCT Pub. Date: Nov. 12, 2015

(65) Prior Publication Data

US 2017/0074027 A1 Mar. 16, 2017

(30) Foreign Application Priority Data

May 5, 2014 (DE) ..... 10 2014 106 226

(51) Int. Cl.
*E06B 3/263* (2006.01)

(52) U.S. Cl.
CPC ..... *E06B 3/26343* (2013.01); *E06B 3/26303* (2013.01); *E06B 3/26305* (2013.01);
(Continued)

(58) Field of Classification Search
CPC ..... E06B 3/26343; E06B 3/26305; E06B 2003/26314; E06B 2003/26316;
(Continued)

(56) References Cited

U.S. PATENT DOCUMENTS 4,815,245 A * 3/1989 Gartner ..... E06B 3/26343 49/DIG. 1
5,694,731 A * 12/1997 Tonsmann ..... E06B 3/26303 49/504

(Continued)

FOREIGN PATENT DOCUMENTS

DE 3203631 A1 8/1983
DE 3334332 A1 4/1985

(Continued)

OTHER PUBLICATIONS

German Search report dated Mar. 18, 2015 in related DE Application No. 10 2014 106 226.4.

(Continued)

*Primary Examiner* — Andrew J Triggs
(74) *Attorney, Agent, or Firm* — Patent Portfolio Builders PLLC

(57) ABSTRACT

A composite profile for doors, windows, or other facade elements includes a first and second metal profile between which at least one intermediate metal profile is provided. The first metal outer profile is connected to the intermediate metal profile in a first insulating web zone via one or more insulating web(s), and the second metal profile is connected to the intermediate profile in a second insulating web zone via one or more insulating web(s). Both the first and second insulating web zones have different shear strengths orthogonally in relation to the cross-sectional plane of the composite profile.

33 Claims, 4 Drawing Sheets

Figure 1:
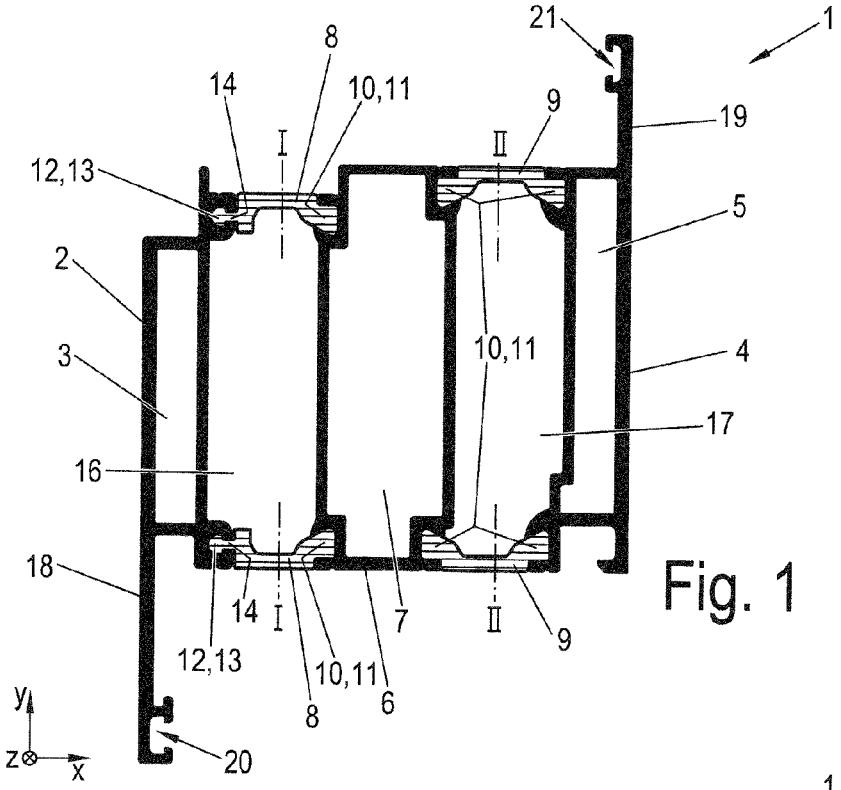

(52) U.S. Cl.
CPC ..... *E06B 2003/2635* (2013.01); *E06B 2003/26314* (2013.01); *E06B 2003/26316* (2013.01); *E06B 2003/26361* (2013.01); *E06B 2003/26365* (2013.01)

(58) Field of Classification Search
CPC ... E06B 2003/26349; E06B 2003/2635; E06B 3/26303
See application file for complete search history.

(56) References Cited

U.S. PATENT DOCUMENTS

| | | | | |
|---|---|---|---|---|
| 6,035,600 | A * | 3/2000 | Habicht | E06B 3/26305 52/573.1 |
| 6,668,500 | B1 * | 12/2003 | Lamberts | E06B 3/26343 49/504 |
| 6,803,083 | B2 * | 10/2004 | Ensinger | E06B 3/26301 428/188 |
| 2003/0019184 | A1 * | 1/2003 | Habicht | E06B 3/273 52/846 |
| 2017/0074027 | A1 * | 3/2017 | Rethmeier | E06B 3/26303 |

FOREIGN PATENT DOCUMENTS

| | | | |
|---|---|---|---|
| DE | 3509466 | A1 | 8/1986 |
| DE | 19956415 | C1 | 3/2001 |
| DE | 19962964 | A1 | 7/2001 |
| DE | 102004038868 | A1 | 2/2006 |
| DE | 202007004804 | U1 | 6/2007 |
| DE | 10201304693 | A1 | 9/2013 |
| DE | 202013105101 | U1 | 1/2014 |
| EP | 0262677 | A2 | 4/1988 |
| EP | 0717165 | A1 | 6/1996 |
| EP | 0829609 | A2 | 3/1998 |
| EP | 1004739 | B1 | 2/2004 |
| EP | 2530230 | A2 | 12/2012 |

OTHER PUBLICATIONS

International Search Report dated Jul. 23, 2015 in related International Application No. PCT/EP2015/059390.
Written Opinion dated Jul. 23, 2015 in related International Application No. PCT/EP2015/059390.

* cited by examiner

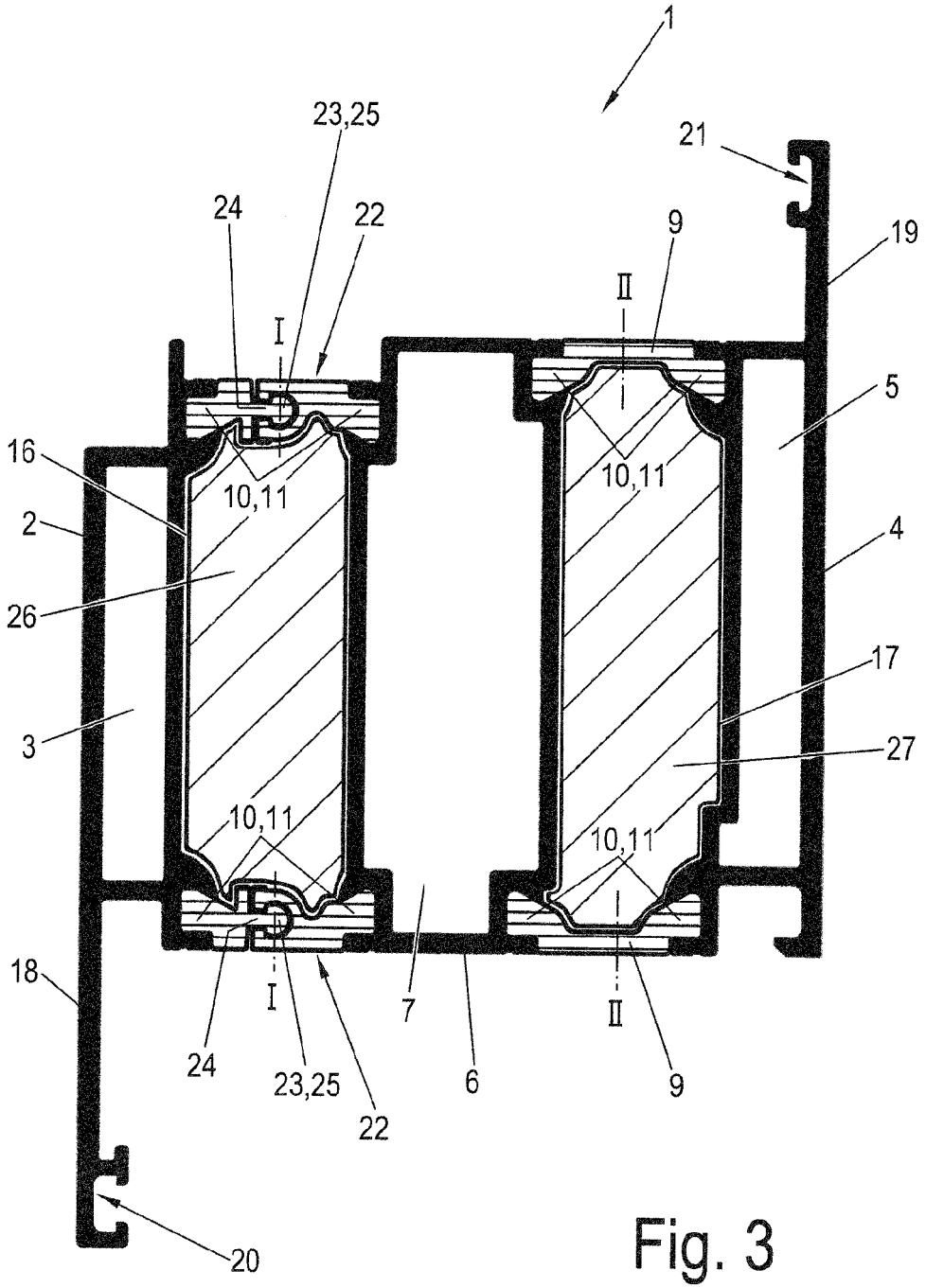
Fig. 3
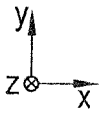

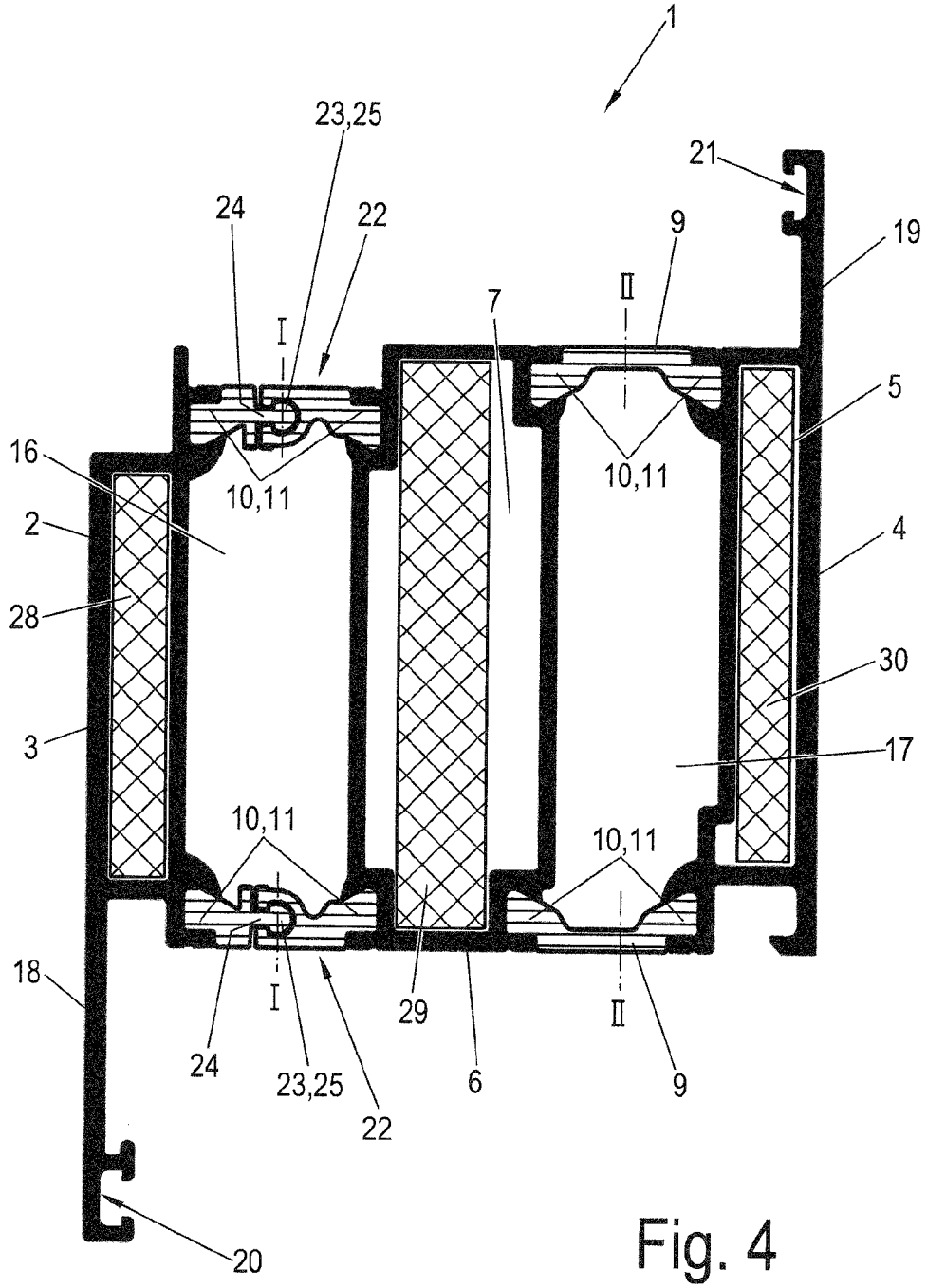
Fig. 4
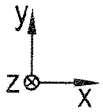

Fig. 5
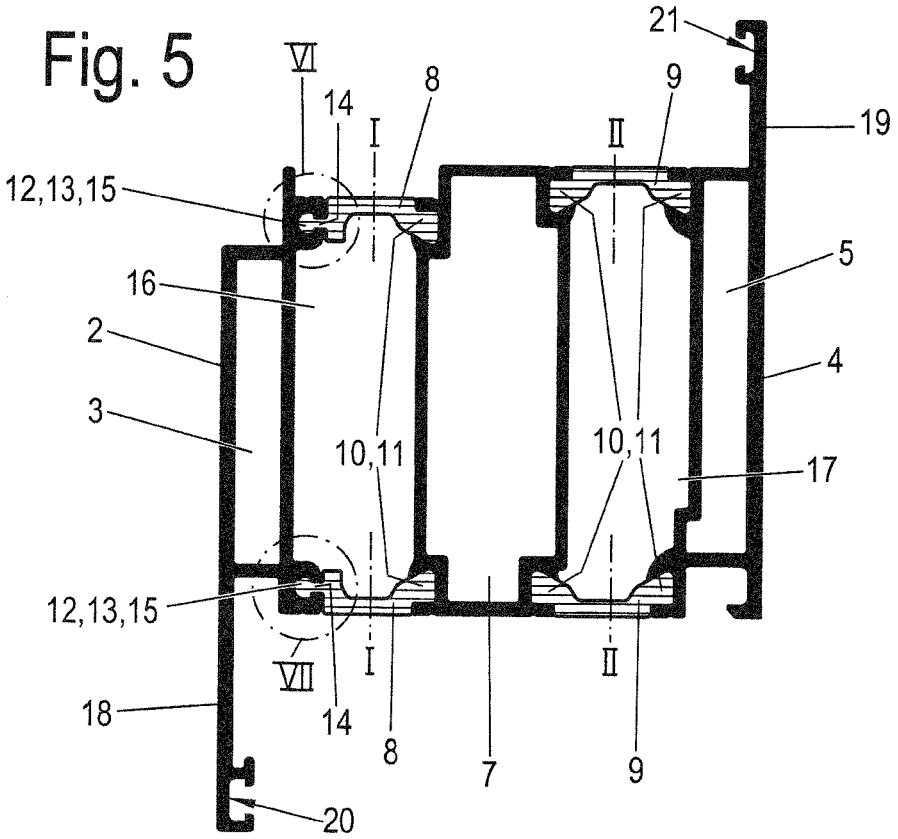
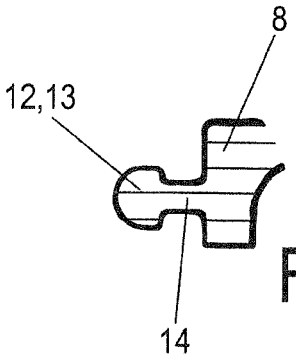
Fig. 6
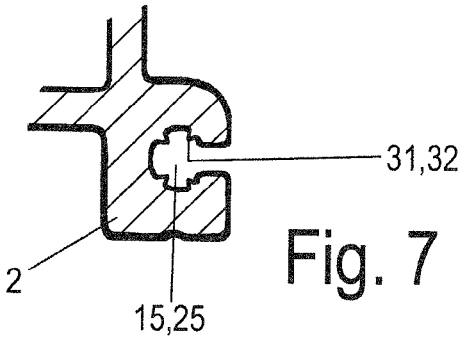
Fig. 7

COMPOSITE PROFILE FOR DOORS, WINDOWS OR FAÇADE ELEMENTS

BACKGROUND AND SUMMARY OF THE INVENTION

Exemplary embodiments of the invention relate to a composite profile for doors, windows or façade elements.

Such composite profiles for doors, windows or other façade elements are known from the state of the art. Thus, a composite profile which has a first and a second metallic exterior profile each with at least one hollow chamber is disclosed in German patent document DE 20 2013 105 101 U1. A middle profile made from a metallic material is located between the two exterior profiles. The metallic middle profile is connected to first exterior profile by one or more spaced insulating bars and is likewise connected with the second exterior profile by at least one or more spaced insulating bars so that good thermal insulation is achieved and relatively long protection against the transmission of flame in the event of fire is achieved.

A preferred—but not constraining—area of application for such composite profiles which have more than two metallic profile sections is for use as door profiles in the interior of buildings with special fire protection requirements.

In composite profiles for doors, windows or façade elements with insulating bars, increases or decreases in temperature on one side, such as those occurring as a result of seasonal variation, lead to shearing stress between the components of the composite profile. As a result of the shear strength of the composite profile, the shearing stress leads to the deformation of the composite profile, resulting in a curvature towards the warmer side of the composite profile. Such deformations can interfere with the function of the door or window frame constructed from the composite profile.

In particular, for relatively long composite profiles used as the frame bars for doors, the temperature-related deformation of the composite profiles has a negative effect on the functioning of the sealing and locking systems.

Solutions are known from the state of the art that address the prevention or mitigation of such stresses and deformations of composite profiles. Thus, European patent document EP 0 829 609 A2 suggests that the shear strength is low, tends towards zero or a sliding guide is present in insulating bars connected to an interior and exterior profile.

According to German patent document DE 20 2007 004 804 U1, an insulating strip has at least two or more insulating strip sections or parts, which move in relation to one another and which are connected to each other by means of bars, wherein the bars are designed such that the two insulating strip parts of the insulating strip can move relative to one another to a limited extent such that bars and the insulating strip parts which are adjacent to one another can swivel into a parallelogram shape in the movement.

German patent document DE 10 2013 204 693 A1 suggests that an insulation bar comprising two sections that slide in relation to one another, used to connect two metal profiles of a thermally insulated composite profile, is designed such that the insulation bar has means, intermittently or across a greater length of the insulation bar, of establishing a locally shear-resistant connection between the two sections of the insulation bar that nonetheless has reduced overall shear strength so that equalisation of the dilation movements is also possible here.

The disadvantage of the solutions from the state of the art is that the design for the insulating bars between the profiles with low or non-existent shear resistance results in a relatively low geometric moment of inertia.

As a result, the permissible static loads for a composite profile according to the state of the art with non-existent or low shear resistance insulating bars are lower than for composite profiles with rigid insulating bars. This results in a disadvantage when such composite profiles are used e.g., for glass facades as well as for large windows or doors so that a more extensive composite profile with non-existent or low shear resistance insulating bars needs to be used for the same static requirements in comparison with a composite profile with rigid insulating bars.

This results in a smaller glazing area and lower incidence of light for a composite profile with non-existent or low shear resistance insulating bars than for a composite profile with rigid insulating bars for the same wall opening area.

In addition, the thermal insulation properties of a composite profile with non-existent or low shear resistance insulating bars according to the state of the art are poorer than those of composite profiles according to the state of the art which have more than two metallic profile sections.

Accordingly, exemplary embodiments of the invention are directed to providing a class-specific composite profile for doors, windows or similar that at least reduces this problem.

According to an exemplary embodiment the two insulating bar zones have different shear strengths orthogonal to the cross-sectional plane of the composite profile. This can be realised through the provision or establishment of a rigid connection between all of the elements that are connected to one another in the first insulating bar zone (this includes single part insulating bars or multi-part insulating bars with their insulating bar sections and the adjacent metal profiles, so the middle metal profile and the corresponding exterior metal profile or exterior profile), while the shear strength of the elements connected to one another in the second insulating bar zone (insulating bars, metal profiles or insulating bar sections) is lower than in the first insulating bar zone at least partially or in sections.

In this way, the invention creates a composite profile for doors, windows or similar that ensures deformation of the profile as a result of temperature influences due to the differing shear strengths of the insulating bar zones and preferably in particular a shear-free or low-shear design of an insulating bar zone. Despite the reduced shear strength design of one of the two insulating zones, the result here is a surprisingly high stiffness of the composite profile.

The reduction of the shear strength in one of the two insulating bar zones can be realised in various different ways. Reference should initially be made to European patent document EP 0 829 609 A2, which discloses the basic fundamental principles of reduced shear strength. Variants of the concepts of this document are shown in German patent documents DE 10 2004 038 868 A1, DE 10 2013 204 693 A1, EP 1 004 739 B1, and DE 199 62 964 A1. The zone with reduced shear strength can be designed as in these documents. It can therefore be designed as a sliding guide that is formed between the insulating profile and one or both adjacent metal profiles. The sliding guide can also be formed between two insulating profile sections. The friction in the sliding guide must not tend towards zero. It can even be increased again locally in the sliding guide by means for generating shear strength, but the overall shear strength here should be lower along the length of the composite profile (concerning a unit of length, for example 1 m) than in the other insulating bar zone.

The two insulating bar sections can also be made from different materials and/or be connected to one another with limited movement using crossbars or similar. Combinations of these measures and other measures to reduce the shear strength in relation to a rigid connection are also conceivable.

In the second insulating bar zone, the shear strength is higher than in the other insulating bar zone. This connection is preferably actually rigid, i.e., as a result of dilation, relative movement of the "insulating bars" or "insulating bar sections or parts" and "metal profiles" elements to be connected in the insulating bar zone is prevented in this insulating bar zone for the purposes of this document using suitable measures and means. This can be well achieved through the rolling of metal profile bars on the heads or end sections of the insulating bars and through supplementary measures such as wires with variable longitudinal thickness or a knurled wire or similar in the roll area. For the purposes of this document, however, a shear-free joint—sometimes also referred to as a low-shear joint—allows for a limited relative movement of the "insulating bars" or "insulating bar sections or parts" and "metal profile" elements adjacent to and to be connected to one another in this insulating bar zone as a result of dilation. In a beneficial design variant, the composite profile has one or more insulating bars having thickened end sections for this purpose, wherein the respective end section can have a trapezoidal, triangular or wedge-shaped, or L-shaped cross-section and the respective end section engages in a groove in the metal profile.

In a beneficial design variant, the insulating bars in the composite profile have an end section having a significantly piping-like cross-section which engages in a groove in a metal profile in order to realise a form of sliding guide. In another beneficial design variant, the insulating bars in the composite profile are made from two insulating bar sections or parts, wherein both parts of the insulating bar in the direction in which the cross-section of the composite profile extends are positively connected with one another using a piping connection. This also serves the realisation of a sliding guide. The piping connection has a piping bead and a piping tag which engages in a groove with the corresponding cross-sectional geometry.

This simply and thus beneficially creates a positive but sliding guide-like connection in the direction in which the cross-section of the composite profile extends between the insulating bars and the metal profiles or within an insulating bar which can, where necessary, easily and beneficially be developed into an almost "shear-free" connection using an agent which minimises friction. In an embodiment, the end section with a piping-like cross-section is not frictionally connected to the groove.

It is particularly beneficial to be able to apply the friction-minimising agent easily, as is the case due to a co-extruded film applied to the piping bead in the piping connection. The film of the co-extruded film, which is in contact with the groove in this case, has a particularly low friction coefficient so that an almost shear-free connection is created in the direction orthogonal to the cross-sectional plane of the composite profile.

In another beneficial embodiment of the present invention, the composite profile has at least one or more hollow chambers, wherein at least one insulating strip is used in one or more of these hollow chambers. The thermal insulation properties of the composite profile are thus simply and beneficially further improved.

In another beneficial embodiment, firebreaks are positioned instead of the insulating strips or in addition to them in other hollow chambers. The fire-protection properties of the composite profile are thus also simply and beneficially further improved. It is particularly beneficial if the firebreaks are always made from a material having properties that cause an endothermic reaction when burnt, as is beneficially the case if the firebreaks are made from a material containing water of crystallisation.

According to an alternative design, it is preferred that the two insulating bar zones I, II have the same shear strength orthogonally to the cross-sectional plane of the composite profile but which is lower than that of a rigid connection.

BRIEF DESCRIPTION OF THE DRAWING FIGURES

Figure 2:
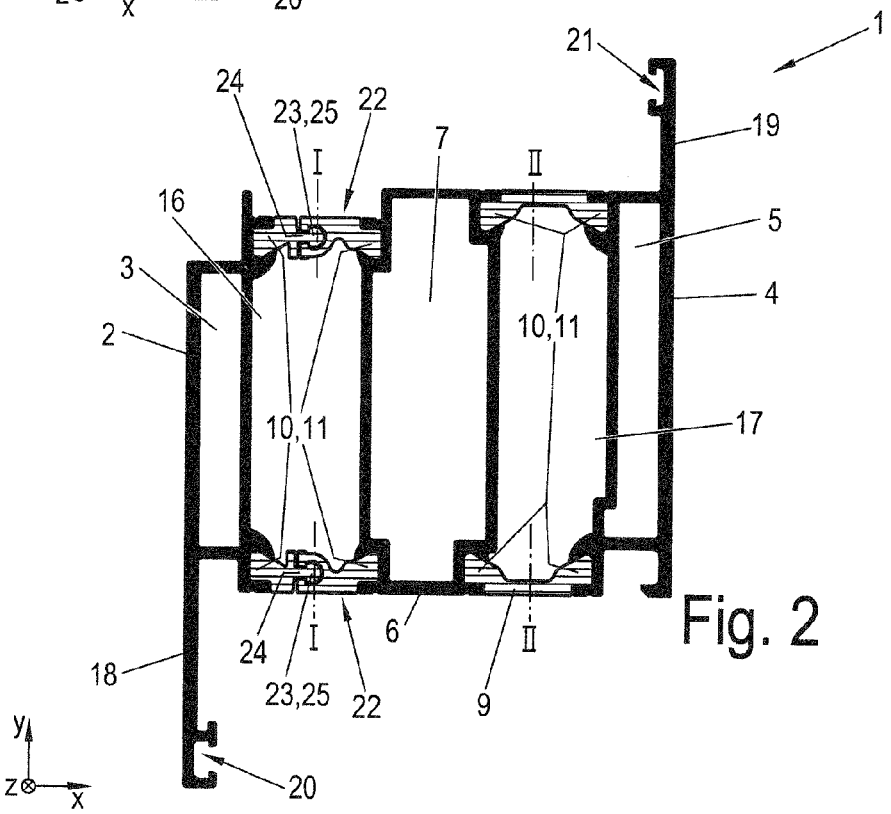

Design examples of the subject according to the invention are shown in the drawings and are described in more detail below. The following are shown:

FIG. 1: a sectional view of a first composite profile according to the invention;

FIG. 2: a sectional view of a second composite profile according to the invention;

FIG. 3: a sectional view of a further design variant for a composite profile according to the invention according to FIG. 2 in which the hollow chambers within the insulating bar zones have additional insulating strips;

FIG. 4: a sectional view of a further design variant for a composite profile according to the invention according to FIG. 2 in which the hollow chambers within the metallic profiles have additional firebreaks;

FIG. 5: a sectional view of a composite profile according to the invention from FIG. 1;

FIG. 6 a detail enlargement of the composite profile according to FIG. 5; from FIG. 7 a further detail enlargement of the composite profile from FIG. 5.

DETAILED DESCRIPTION

FIG. 1 shows a composite profile 1 according to the invention. This composite profile 1 can be used as a sash frame profile as part of a sash frame or blind frame for doors, windows or other façade elements such that the following description refers equally to sash frame profiles and blind frame profiles.

The composite profile 1 has a first metal profile, a metallic exterior profile 2, in which at least one hollow chamber 3 is designed, and a second metallic exterior profile 4, in which at least one hollow chamber 5 is likewise designed. Between the two metal profiles 2 and 4 is a third metal profile, a metallic middle profile 6, in which at least one hollow chamber 7 is likewise designed.

The metallic profiles 2, 4, 6 can alternatively be designed without distinct hollow chambers 3, 5, 7 or can have multiple hollow chambers.

The first metallic exterior profile 2 is connected to the metallic profile 6 using at least one or more first insulating bars (here parallel) 8. These insulating bars 8 between the first metallic exterior profile 2 and the metallic middle profile 6 form the first insulating bar zone I or layer. The second metallic exterior profile 4 is likewise connected to the metallic middle profile 6 using at least one or more second (here parallel) insulating bars 9. The insulating bars 9 between the second metallic exterior profile 4 and the metallic middle profile 6 form a second insulating bar zone II or layer.

The first and second insulating bars 8, 9 here—purely as an example—have no hollow chambers. Alternatively, the insulating bars 8, 9 can also have one or more hollow chambers or the respective first or respective second insulating bars can be collected into a form of superordinate insulating profile using crossbars.

Here, the insulating bars 8, 9 in the insulating bar zones I, II—purely as an example—lie within a plane. Alternatively, it is also possible for the insulating bars 8, 9 in the insulating bar zones I, II to be arranged offset vertically or horizontally from one another.

The first and second metallic exterior profiles 2 and 4, as well as the metallic middle profile 6, are preferably made from extruded aluminium profiles. Alternatively, they can also be made from a different material such as steel and/or using a different manufacturing process. The insulating bars 8 and 9 are made from a material that reduces heat transition, preferably from a plastic material such as polyurethane so that extensive thermal separation is always achieved between the metal profiles 2, 4, 6. Alternatively, metallic insulating bars with reduced heat conductivity that can be equipped with breaks or openings in order to reduce the heat transition (as disclosed in European patent document EP 0 717 165 A2, for example) can also be used.

The cross-section of the insulating bars 8 and 9 is preferably designed to be bar-shaped and has a thickened end section 10. As a result, each of the end sections 10 preferably engages in a corresponding groove 11 in each of the metal profiles 2, 4, 6, wherein the walls of the groove preferably grasp the thickened end sections 10 of the insulating bars 8, 9 positively in the x and y directions (see coordinate system in FIG. 1). The respective end section 10 preferably has a trapezoidal, or triangular or wedge-shaped, or L-shaped, or rectangular cross-section. Accordingly, the respective groove 11 has a cross-section with the respective corresponding cross-section.

In order to achieve a rigid and thus additionally frictional connection between the respective end section 10 and the respective groove 11, it is beneficial for the respective end section 10 to be glued into the respective groove 11 or inserted with a wire or inserted into the groove 11 using another suitable joining process, which increases the shear strength in the profile direction (vertically to the drawing plane for FIG. 1) caused by an interlocking effect.

In FIG. 1—here purely as an example—the second insulating bar zone II has the second insulating bars 9, the respective end sections 10 of which are connected positively and frictionally to the respective groove 11 so that a rigid connection between the second insulating bars 9 and the exterior and middle metal profiles adjacent to them occurs, in particular in a z-direction (cf. coordinates system in FIG. 1) or in a direction orthogonally to the cross-sectional plane of the composite profile 1. This connection is hereinafter referred to as a rigid design of one of the two—here the second—insulation bar zones. It offers shear strength against the forces occurring as a result of dilation on a window or a door or similar.

The rigidity of the other—here the first—insulating bar zone I is lower in comparison to that of the first insulating bar zone II in all variants. It is selected in such a way that movement of at least two elements in the insulating bar zone relative to one another is possible as a result of dilation. The insulating bar zone I with lower rigidity is preferably positioned towards the outside of the building in the installed state on a window or a door since the temperature difference is greater here than on the inside of the building so that the lower rigidity is particularly important here for offsetting dilation effects. In contrast, the insulating bar zone with higher rigidity is preferably positioned towards the inside of the room. This variant of the invention is particularly beneficial. However, is it also possible to position the insulating bar zone with higher rigidity towards to outside of the room.

The first insulating bar zone I preferably—see FIG. 1—has insulating bars 8 which have a first end section 10 on their two ends, which are connected positively and frictionally with the corresponding groove 11 resulting in a rigid connection, particularly in the z-direction (cf. coordinates system in FIG. 1).

The second ends of the insulating bars 8 in the first insulating bar zone I, on the other hand, have an end section 12 having a generally piping-like cross-section. The piping-like cross-section is formed of a piping bead 13 and a piping tag 14. Here—purely as an example—the piping bead 13 has a circular cross-section. The piping bead 13 can alternatively also have a non-round or oval or polygonal cross-section. The actual piping bead thus engages in a groove 15—here likewise purely as an example—in the first metallic exterior profile 2, while the piping tag 14 is guided out of a groove opening from the groove 15, wherein the groove walls surround the respective end sections 12 positively with a generally piping-like cross-section of the insulating bars 8 in the x- and y-direction (see coordinates system in FIG. 1).

The end section 12 with a generally piping-like cross-section is—differing from end section 10—however not rigidly connected with the groove 15 so that a reduced shear connection—also synonymously referred to as a low-shear or shear-free joint in the state of the art—is created in the z-direction (see coordinates system in FIG. 1), which can beneficially absorb deformations in the first metallic exterior profile 2 caused by temperature. The characteristics of a low-shear or shear-free joint according to the invention in end section 12 of an insulating bar 8 are shown in FIGS. 5, 6 and 7.

Thereby, a composite profile 1 is created, which always has a reduced shear, in particular a low-shear or shear-free connection, relative to other insulating bar zone, between the first metallic exterior profile 2 and the insulating bars 8 or the metallic middle profile 6 in the first insulating bar zone I in relation to the z direction (cf. coordinates system in FIG. 1), while the second insulating bar zone II always has a rigid connection between the second metallic exterior profile 4 and the insulating bars 9 or the metallic middle profile 6

Alternatively, a composite profile 1 according to the invention can also have a reduced shear, i.e., low-shear or shear-free connection between the second metallic exterior profile 4 and the insulating bars 9 or the metallic middle profile in the second insulating bar zone II, while the first insulating bar zone I has a connection, which is (more) rigid in comparison with the reduced shear connection, between the first metallic exterior profile 2 and the insulating bars 8 or the metallic middle profile 6.

This results in a composite profile 1 that can compensate for deformations caused by temperature through a low-shear or shear-free connection between the metallic exterior profile 2, 4 and the respective insulating bars 8, 9 or the metallic middle profile 6 as well as—surprisingly—a composite profile 1 with a high geometric moment of inertia and a $2^{nd}$ degree moment of area.

In a less preferred embodiment of the present invention, the composite profile 1 can also have a low-shear or shear-free connection between the metallic exterior profiles 2, 4 and the respective insulating bars 8, 9 or the metallic middle profile 6 in both insulating bar zones I, II in relation to the z direction (cf. coordinates system in FIG. 1).

The first metallic exterior profile 2 is preferably separated from the metallic middle profile 6 by a hollow chamber 16 formed in the first insulating bar zone I between the two first insulating bars 8 and the adjacent metal profiles, while the metallic middle profile 6 is separated from the second metallic exterior profile 4 by a hollow chamber 17 located in the second insulating bar zone II between the second insulating bars 9 and the adjacent metal profiles. A multitude of hollow chambers 3, 16, 7, 17, and 5 are thus formed from one exterior side of the first metallic exterior profile 2 to the second exterior side of the second metallic exterior profile 4, thus ensuring good thermal insulation.

The metallic exterior profiles 2 and 4 have bars 18 and 19 protruding outwards on opposite sides, wherein there is a groove 20 on the end of the bar 18 to hold a seal and there is another groove 21 on the bar 19 to hold a seal. Depending on the function type (sash or blind frame), the bars 18 and 19 can also be available on one side, just one of these bars may be available or neither of the bars may be available.

FIG. 2 shows an alternative embodiment of a composite profile 1 according to the invention. In order to avoid repetition, it is predominantly the differences and additions to the embodiment according to FIG. 1 which are described below.

In FIG. 2, the insulating bars 22 in the first insulating bar zone I between the first metallic exterior profile 4 and the metallic middle profile 6 have two insulating bar sections or segments or parts that move relative to one another. Preferably, a sliding guide is formed between the segments. However, it is also conceivable that cross-connection bars are designed between the segments of the insulating bars, which are in turn designed such that the segments are able to move in relation to one another (not shown).

The insulating bars 22 in the first insulating bar zone I each have trapezoidal end sections 10 on both ends that each engage in the groove 11 in the first metallic exterior profile 4 and the metallic middle profile 6, wherein the groove walls positively surround the thickened end sections 10 of the insulating bars 22 in the x and y directions (see coordinates system in FIG. 2). A knurled wire can also be positioned in this area. The respective end sections 10 have a trapezoidal, or triangular or wedge-shaped, or L-shaped cross-section. The corresponding groove 11 accordingly has a cross-section with the corresponding cross-section.

In order to maintain a rigid and thus also frictional connection between the respective end section 10 and the respective groove 11, the respective end sections 10 and the respective groove 11 are glued and/or inserted with a wire or inserted into the groove 11 with another suitable joining process.

Each of the two segments of the insulating bars 22 are positively connected together in the y and x direction (referring to the coordinates system in FIG. 2) using a piping connection. A first segment of the insulating bar 22 has a piping bead 23 and a piping tag 24. The other segment on the other hand has a groove 25 with the corresponding cross-sectional geometry so that the piping bead 23 engages in the groove 25 and the piping tag 24 is guided out of the groove 25. A sliding guide is formed in this manner.

The rigidity in the sliding guide orthogonal to the cross-sectional plane of the composite profile can, but must not, tend towards zero. Due to a type of brake such as an elastomer on the sliding guide, it can also be greater than that of a pure sliding guide without such a brake. Preferably, however, the rigidity in the zone with reduced shear strength is clearly, i.e., preferably at least 50% lower than the rigidity in the other insulating bar zone. The two segments can also be firmly bonded to one another. Instead of a sliding guide, the limitation of the relative movement in the primary direction in which the composite profile extends (vertically to the drawing layer) can also be otherwise achieved, for example through connection of the bars such that the relative movement in relation to one another is limited orthogonally to the cross-section of the profiles and vertically to their longitudinal extension.

In relation to the z-direction (cf. coordinates system in FIG. 2), however, the connection is designed as low-shear or shear-free—i.e., with reduced shear in comparison with a rigid connection. Characteristics of a low-shear or shear-free connection in the end section 12 of an insulating bar 8 which can also correspondingly be used on a low-shear or shear-free connection of a two-part insulating bar 22 according to the invention are shown in FIGS. 5, 6 and 7.

Thus, this embodiment provides a composite profile 1 having a low-shear or shear-free connection between the first metallic exterior profile 2 and the metallic middle profile 6 respectively in relation to the z-direction (cf. coordinates system in FIG. 1) in the first insulating bar zone I, while the second insulating bar zone II has a rigid connection between the second metallic exterior profile 4 and the insulating bars 9 or the metallic middle profile 6 respectively.

Alternatively, a composite profile 1 according to the invention can also have a low-shear or shear-free connection between the second metallic exterior profile 4 and the metallic middle profile 6 respectively in the second insulating bar zone II, while the first insulating bar zone I has a rigid connection between the first metallic exterior profile 2 and the insulating bars 8 or metallic middle profile 6 respectively.

This results in a composite profile 1 that can compensate for deformations caused by temperature through a low-shear or shear-free connection between one of the metallic exterior profiles 2, 4 and the respective insulating bars 8 or the metallic middle profile 6 as well as—surprisingly—a composite profile 1 with a high geometric moment of inertia and a $2^{nd}$ degree moment of area.

In another alternative embodiment of the present invention, the composite profile 1 can also have a low-shear or shear-free connection between the metallic exterior profiles 2, 4 and the respective insulating bars 8 or the metallic middle profile 6 in both of the insulating bar zones I, II in relation to the z direction (cf. coordinates system in FIG. 1).

FIG. 3 shows another design variant for a composite profile according to the invention according to FIG. 2.

In FIG. 3, the hollow chambers 16, 17 in the first metallic exterior profile 2 and the second metallic exterior profile 4 each have a thermal insulation strip 26, 27. The thermal insulation strips 26, 27 are designed here—purely as an example—as inserted thermal insulation strips. Alternatively, the thermal insulating strips 26, 27 can also be foam sealed in the hollow chambers 16, 17 of the first metallic exterior profile 2 and the second metallic exterior profile 4. The thermal insulation strips 26, 27 are always made from a plastic material, preferably from a foamed plastic material, in particular preferably polyurethane foam.

According to FIG. 4, the metallic exterior profiles 2 and 4 and the metal middle profile 6 each have firebreaks 28, 29, 30 in the hollow chambers 3, 5, 7. In the event of a fire, heat is first applied to one side of the composite profile 1, whereby first of all the firebreaks 28 or 30 in one of the metallic profiles 2 or 4 release the water of crystallisation preferably bound in the firebreaks 28 or 30 and are thus able to cool the corresponding metallic exterior profile 2 or 4 for a short time.

FIG. 5 and/or FIG. 6 and FIG. 7 each show another design variant for a composite profile according to the invention according to FIG. 1.

FIG. 6 shows the design variants for the piping beads 13 and 23. In FIG. 6, the piping bead 13 or 23 has a circular cross-sectional geometry. Alternatively, the cross-sectional geometry for the piping bead 13 or 23 can also be oval, elliptical or polygonal.

In addition, the piping bead 13 or 23 can have a co-extruded film or layer on its surface. The co-extruded film can be structure such that the film that comes into contact with the groove 15 of the first metallic profile 2 or with the second metallic profile 4 or with the groove 25 in the insulating bar 22 has a lower friction coefficient, for example, while the other side of the film or layer which comes into contact with the insulating bar 8, 22 forms a solid connection with the insulating bar 8, 22. The co-extruded film thus creates a layer solidly connected with the respective insulating bar 8, 22 overall with a particularly low friction coefficient in the piping bead 13 or 23 area so that a virtually shear-free or low-shear connection is created in the z direction (see coordinates system in FIG. 1 and FIG. 2).

FIG. 7 shows a groove 15 or 25 in a metal profile or an insulating bar section. The groove 15 or 25 has a circular cross-sectional geometry. Alternatively, the cross-sectional geometry of the groove 15 or 25 can be oval, elliptical or polygonal, this being dependent on the cross-sectional geometry chosen for the piping bead 13 or 23 with which the cross-sectional geometry of the groove 15 or 25 corresponds. In an alternative embodiment, the groove 15 or 25 can have a splined hub-like cross-sectional geometry 31 or a spline shaft hub-like cross-sectional geometry.

A low friction connection between the insulating bar 8, 22 and the groove 15 or 25 in the respective metallic exterior profile 2, 4 or in the insulating bar 22 results from a contact between a plurality of teeth 32 on a splined hub 31 or a plurality or wedges (not shown here) of the groove 15 or 25 in the first metalling profile 2 or in the second metallic profile 4 or in the insulating bar 22 so that a low-shear connection is created in the z-direction (see coordinates system in FIG. 1 or FIG. 2). In addition, the teeth on the splined hub or the wedges on the spline shaft hub contribute to tolerance compensation between the piping bead 13 or 23 and the groove 15 or 25.

Although the present invention has been described above by means of embodiments with reference to the enclosed drawings, it is understood that various changes and developments can be implemented without leaving the scope of the present invention, as it is defined in the enclosed claims.

The invention claimed is:

1. A composite profile for doors, windows or façade elements, the composite profile comprising:

a first metal profile;

a second metal profile;

a middle metal profile arranged between the first and second two metal profiles, wherein the first metal profile is connected to the middle metal profile in a first insulating bar zone via one or more first insulating bars, wherein the second metal profile is connected to the middle metal profile in a second insulating bar zone via one or more second insulating bars, wherein the first and second insulating bar zones have different shear strengths orthogonally to a cross-sectional plane of the composite profile.

2. The composite profile of claim 1, wherein a rigid connection having a first rigidity is formed between elements connected to one another in one of the first and second insulating bar zones and a connection of elements to one another in the other of the first and second insulating bar zones has a second rigidity that is lower than the first rigidity.

3. The composite profile of claim 1, wherein a sliding guide is formed between elements connected with each other in one or both of the first and second insulating bar zones.

4. The composite profile of claim 1, wherein the first and second insulating bars have a thickened end section on one or both of their ends.

5. The composite profile of claim 4, wherein at least one of the ends have a trapezoidal, triangular, wedge-shaped, or L-shaped cross-section, and respective end sections each engage in a corresponding groove in each of the first and second metal profiles.

6. The composite profile of claim 5, wherein walls of a respective groove positively grasp a respective end section of the first and second insulating bars in a direction in which a cross-section of the composite profile extends.

7. The composite profile of claim 5, wherein a respective end is glued into a respective groove, inserted with a wire, inserted frictionally, or inserted positively into the groove in relation to a direction orthogonal to a cross-sectional plane of the composite profile.

8. The composite profile of claim 1, wherein at least one of the first and second insulating bars have at least one end section having a generally piping-like cross-section formed of a piping bead and a piping tag.

9. The composite profile of claim 8, wherein the piping bead engages in a groove in one of the first and second metal profiles, and the piping tag is guided out of a groove opening out of the groove.

10. The composite profile of claim 9, wherein walls of the groove positively grasp an end section of the one or more first or second insulating bars with a generally piping-like cross-section in a direction in which the cross-section of the composite profile extends.

11. The composite profile of claim 10, wherein the end section with a piping-like cross-section is not frictionally connected to the groove.

12. The composite profile of claim 1, wherein the one or more first insulating bars have two segments that are moveable in relation to one another.

13. The composite profile of claim 12, wherein a sliding guide is formed between the two segments.

14. The composite profile of claim 13, wherein a braking system, which increases local shear strength, is arranged on the sliding guide.

15. The composite profile of claim 12, wherein crossbars are arranged between the two segments of the first insulating bars, and the crossbars are configured such that the two segments are moveable in relation to one another.

16. The composite profile of claim 12, wherein the two segments of the one or more first insulating bars are positively connected to one another, in a direction in which a cross-section of the composite profile extends, by a sliding guide.

17. The composite profile of claim 1, wherein one half of the one or more first or second insulating bars has a piping bead and a piping tag.

18. The composite profile of claim 17, wherein one half of the one or more first or second insulating bars has a groove with cross-sectional geometry corresponding to that of the piping bead and piping tag.

19. The composite profile of claim 18, wherein the piping bead has a circular, non-round, oval, or polygonal cross-section.

20. The composite profile of claim 18, wherein the groove has splined hub-like cross-sectional geometry or a spline shaft hub-like cross-sectional geometry.

21. The composite profile of claim 17, wherein the piping bead has a co-extruded film on its surface.

22. The composite profile of claim 21, wherein the co-extruded film has a film layer configured to lower a friction coefficient in connection with the first and second metal profiles.

23. The composite profile of claim 1, wherein the one or more first or second insulating bars have a bar-shaped cross-section.

24. The composite profile of claim 1, wherein the one or more first or second insulating bars have a hollow chamber.

25. The composite profile of claim 1, wherein the one or more first and second insulating bars lie within a plane or are arranged each offset vertically or horizontally from one another.

26. The composite profile of claim 1, wherein the first or second insulating bars are made from a foamed polyurethane.

27. The composite profile of claim 1, wherein the first, second, and middle metal profiles are aluminium.

28. The composite profile of claim 1, wherein at least one of the first, second, and middle metal profiles has at least one hollow chamber.

29. The composite profile of claim 1, wherein at least one hollow chamber is arranged in the first and second insulating bar zones.

30. The composite profile of claim 29, wherein at least one of the hollow chambers has thermal insulation strips.

31. The composite profile of claim 29, wherein at least one of the hollow chambers has firebreaks.

32. A window, door, or façade element, comprising:

a composite profile, which comprises a first metal profile;

a second metal profile;

a middle metal profile arranged between the first and second two metal profiles, wherein the first metal profile is connected to the middle metal profile in a first insulating bar zone via one or more first insulating bars, wherein the second metal profile is connected to the middle metal profile in a second insulating bar zone via one or more second insulating bars, wherein the first and second insulating bar zones have different shear strengths orthogonally to a cross-sectional plane of the composite profile.

33. The window, door, or façade element of claim 32, wherein the one of the first and second insulating bar zones having a reduced shear strength relative to the other of the first and second insulating bar zones is arranged on a side of the window, door, or façade element configured for orientation towards an outside of a room.

* * * * *